US011085687B2

(12) United States Patent
Leal et al.

(10) Patent No.: US 11,085,687 B2
(45) Date of Patent: Aug. 10, 2021

(54) FLEXIBLE TRAY AND METHOD OF TRANSPORTING AND STORING MANUFACTURED ICE SHAPES

(71) Applicants: Carlos Leal, Miami, FL (US); Fabian Alvarez, Miami Beach, FL (US)

(72) Inventors: Carlos Leal, Miami, FL (US); Fabian Alvarez, Miami Beach, FL (US)

( * ) Notice: Subject to any disclaimer, the term of this patent is extended or adjusted under 35 U.S.C. 154(b) by 189 days.

(21) Appl. No.: 16/033,318

(22) Filed: Jul. 12, 2018

(65) Prior Publication Data

US 2020/0018535 A1 Jan. 16, 2020

(51) Int. Cl.

| | |
|---|---|
| ***F25C 1/243*** | (2018.01) |
| *B65D 1/36* | (2006.01) |
| *F25C 1/04* | (2018.01) |
| *F25C 1/246* | (2018.01) |

(52) U.S. Cl.

CPC ..... *F25C 1/243* (2013.01); *B65D 1/36* (2013.01); *F25C 1/04* (2013.01); *F25C 1/246* (2013.01)

(58) Field of Classification Search

CPC .. F25C 1/243; F25C 1/246; F25C 1/22; B65B 23/14; B65B 23/12; B65B 23/10; B65D 1/36; B65D 1/24; B65D 1/44; B65D 81/025; B65D 81/3813; B65D 3/262; B65D 5/48002; B65D 1/30; B65D 1/34; B29C 39/26

USPC ..... 249/127, 129

See application file for complete search history.

(56) References Cited

U.S. PATENT DOCUMENTS

| | | | | |
|---|---|---|---|---|
| 1,907,503 A * | 5/1933 | Chilton | F25C 1/24 | 249/52 |
| 1,988,117 A * | 1/1935 | Geyer | F25C 1/24 | 249/127 |
| D159,356 S * | 7/1950 | Lippincott | D15/90 | |
| 3,074,582 A * | 1/1963 | Martelli | B65D 85/34 | 217/26.5 |
| 3,078,986 A * | 2/1963 | Meyer | B65D 77/2032 | 206/484 |
| 3,171,562 A * | 3/1965 | Weiss | B65D 85/34 | 217/26.5 |

(Continued)

OTHER PUBLICATIONS

The Wiley Encyclopedia of Packaging Technology (Aaron L Brody & Kenneth S. Marsh, eds., 2nd ed. 1997) Retortable Packaging pp. 808-811.

(Continued)

*Primary Examiner* — Xiao S Zhao
*Assistant Examiner* — Emmanuel S Luk
(74) *Attorney, Agent, or Firm* — Foley Hoag LLP

(57) ABSTRACT

A packaging assembly for transporting and storing ice includes a tray having a base portion and a plurality of compartments formed on the base portion configured to receive at least one piece of ice, optionally manufactured by a multi-day freeze process followed by shaping and three-dimensional machine cutting. Each compartment includes an opening formed on the base portion of the packaging assembly, a bottom portion substantially parallel to the base portion, at least one sidewall having a first end and a second end, the at least one sidewall connecting the base portion to the bottom portion, and at least one volume strip formed in a respective at least one sidewall. The plurality of compartments are formed as at least one of a circular frustum, a square frustum, and a rectangle frustum.

13 Claims, 4 Drawing Sheets

(56) References Cited

U.S. PATENT DOCUMENTS 3,480,251 A * 11/1969 Pietrzak ..... F25C 1/243 249/127
3,561,158 A * 2/1971 Marcan ..... A01G 9/0295 47/87
3,565,321 A * 2/1971 Weiss ..... B65D 5/503 229/120.07
3,578,235 A * 5/1971 Weiss ..... B65D 1/36 229/120.07
3,674,168 A * 7/1972 Padovani ..... B65D 85/34 217/26.5
D228,543 S * 10/1973 Jansen ..... D9/760
4,159,771 A * 7/1979 Komatsu ..... B65D 75/327 206/526
4,366,941 A * 1/1983 Harris ..... F25C 1/22 206/511
4,831,811 A * 5/1989 Nixon, Jr. ..... B65B 31/021 426/316
4,899,976 A * 2/1990 Cederroth ..... F25C 1/243 249/61
5,091,199 A * 2/1992 Mally ..... B65D 71/72 206/485
5,196,127 A * 3/1993 Solell ..... F25C 1/243 221/91
5,393,032 A * 2/1995 Cederroth ..... B65D 75/327 156/711
5,695,798 A * 12/1997 Rozzano ..... B65D 1/36 206/518
D417,785 S * 12/1999 Daniels ..... D3/313
7,093,816 B2 * 8/2006 Lacan ..... F25C 1/243 249/121
D579,769 S * 11/2008 Lipinski ..... D9/759
D587,109 S * 2/2009 Lyon ..... D9/737
D591,174 S * 4/2009 Larson ..... D9/425
D616,266 S * 5/2010 Kulzer ..... D7/701
D616,267 S * 5/2010 Kulzer ..... D7/701
D616,714 S * 6/2010 Kulzer ..... D7/701
7,731,150 B2 * 6/2010 Campbell ..... B29C 33/405 249/127
D620,350 S * 7/2010 Hernandez ..... D9/425
7,775,017 B2 * 8/2010 Stowell ..... B29C 66/9241 53/287
7,823,742 B2 * 11/2010 Valentine ..... B65D 75/327 206/469
D642,484 S * 8/2011 Birchmeier ..... D9/425
D643,266 S * 8/2011 Kulzer ..... D7/553.2
8,251,219 B1 * 8/2012 Lewis ..... B65D 75/327 206/528
D719,025 S * 12/2014 Ramirez ..... D9/456
D792,240 S * 7/2017 Sellari ..... D9/756
D803,701 S * 11/2017 Sellari ..... D9/756
2004/0134358 A1 * 7/2004 Hopkins, Sr. ..... A47J 36/027 99/451
2004/0182989 A1 * 9/2004 De Buyer ..... A21B 3/132 249/127
2006/0266915 A1 * 11/2006 Parker ..... F25C 1/24 249/66.1
2007/0209958 A1 * 9/2007 Begim ..... B65D 75/22 206/472
2008/0063760 A1 * 3/2008 Raymond ..... B65D 81/3453 426/127
2009/0159483 A1 * 6/2009 Hinze ..... B65D 75/327 206/548
2011/0233092 A1 * 9/2011 Slattery ..... B65D 1/36 206/427
2018/0086525 A1 * 3/2018 Johnson ..... B65D 23/102
2019/0071217 A1 * 3/2019 Brown ..... B65D 85/36
2020/0399053 A1 * 12/2020 Van Dinter ..... B65D 71/70

OTHER PUBLICATIONS

Cadden, Popular Science, "47 ice cube trays for the chillest people you know" Feb. 24, 2017 https://www.popsci.com/best-novelty-ice-molds-trays#page-24 (accessed Jul. 10, 2018).

* cited by examiner 200
202
204

200
201
202
203
204
218

200
250
201
210
202
204
203
2B
2B
211

200
203
260

250
261
262
261
204
219
260
214
213
100
217
218
260

FLEXIBLE TRAY AND METHOD OF TRANSPORTING AND STORING MANUFACTURED ICE SHAPES

FIELD OF INVENTION

This invention relates to flexible packaging, and more particularly to a semi-rigid tray for transporting, storing, and dispensing ice. It also relates to the manufacture of handcrafted and artisanal ice for placement into the trays.

BACKGROUND

There is an increasing demand for handcrafted ice as a means of cooling various beverages, including carbonated soft-drinks, alcohol-containing drinks, cocktails, fruit beverages, functional drinks (i.e., energy drinks), sports drinks, coffee drinks, tea drinks, etc. Numerous commercial establishments, including bars, restaurants, hotels, and event spaces use handcrafted ice to enhance beverages served to customers. To this end, various shapes and forms of handcrafted ice have been developed, each variation having its own unique, desirable characteristics and behavior which can be utilized, for example, for a particular beverage or for a wide variety of beverages.

The process of manufacturing handcrafted ice in sufficient quantity to satisfy this demand is problematic. Part of the problem involves creating and maintaining the desirable characteristics and behavior of the handcrafted ice. These desirable features can be, for example, the clarity, shape, absence of cracks or blemishes, etc. of the ice. To ensure that these features are created and maintained can be an extremely labor and resource intensive process.

One approach to address these issues involves each individual commercial establishment forming, shaping, and maintaining the ice until served. However, this process is burdensome to the commercial establishment as it requires a significant expenditure of time and resources, which is either passed to the customer or internalized by the commercial establishment.

An alternative approach involves forming, shaping, and maintaining the ice by a third party, which specializes in manufacturing handcrafted ice. By off-loading the expensive process of manufacturing handcrafted ice, the commercial establishment can avoid spending unnecessary amounts of time and resources, while at the same time, have a reliable source of handcrafted ice. Additionally, by utilizing economies of scale, the third party specializing in manufacturing handcrafted ice can offer a product at reduced cost.

This alternative approach, however, creates additional logistical issues, as it is becomes necessary to transport the handcrafted ice from the third party to the commercial establishment. Ideally, the transportation of the handcrafted ice would be conducted in a manner in which all of the desirable characteristics and behavior of the handcrafted ice are not only maintained during transport but also until the ice is served to a customer.

SUMMARY

This specification describes technology relating to flexible packaging relating to transporting, storing, and dispensing ice. Implementations of the technology described herein comprise a flexible packaging tray capable of maintaining desirable features of ice during transportation and storage of the ice, and a method by which the device is used to transport and store the ice. Subject matter of the present application relates to subject matter in The Wiley Encyclopedia of Packaging Technology (Aaron L Brody & Kenneth S. Marsh, eds., 2nd ed. 1997), the entire content of which is hereby incorporated by reference herein; and more particularly reference is made to the section on Retortable Packaging (beginning at page 808).

The use of trays to form ice cubes is known. See, e.g., http://www.popsci.com/best-novelty-ice-molds-trays#page-24 (accessed Jul. 10, 2018). These types of trays are utilized by filling individual compartments of a tray with a liquid and placing the tray inside a refrigeration compartment until the liquid freezes and becomes a solid, resulting in an ice cube. The resulting shape of the ice cube is defined by the shape of the compartment of a particular tray. To remove the ice cube from its compartment, a force is applied to the tray. Removing the ice cube from the tray may require a significant force, as the frozen ice cube typically adheres to sides of the compartment during the freezing process. Moreover, by utilizing the trays and processes of the present invention for storage and transport after forming, as opposed utilizing the trays for formation, the nature of the ice cubes is significantly improved (such as, but not limited to, in terms of clarity, precision and uniformity of shape, and transportability).

The technology described in this specification fundamentally differs from known trays used to form ice cubes. The flexible packaging described herein is not utilized for the creation of ice cubes; rather, after an ice cube has been formed, the ice cube may be placed inside a compartment of a flexible packaging for transportation, storage, and/or dispensing of the ice. The shape of the ice cube is not defined by the shape of the compartment of the flexible packaging described in this specification. Instead, the shape and geometry of a compartment of the flexible packaging is selected to ensure that the ice cube maintains its desirable features.

An example embodiment of the present invention relates to a packaging assembly for transporting and storing ice, the packaging assembly including a tray having a base portion, and a plurality of compartments each formed on the base portion and configured to receive at least one piece of ice. In an example embodiment, each compartment includes an opening formed on the base portion, a bottom portion substantially parallel to the base portion, at least one sidewall having a first end and a second end, the at least one sidewall connecting the base portion to the bottom portion, and at least one volume strip formed in a respective at least one sidewall. In an example embodiment, the packaging assembly includes four compartments.

In an example embodiment, the at least one sidewall is formed as a circular frustum so that the first end has a diameter larger than a diameter of the second end. In an example embodiment, the second end of the sidewall is connected to the bottom portion at an angle that is greater than approximately 90° to facilitate release of the product from the tray. In an example embodiment, the second end of each sidewall is connected to the bottom portion at an angle that is 94°.

In example embodiment, each compartment includes four sidewalls so that each compartment is formed as at least one of a square frustum and a rectangle frustum. In an example embodiment, the second end of each sidewall is connected to the bottom portion at an angle that is greater than 90°. In an example embodiment, the second end of each sidewall is connected to the bottom portion at an angle that is 93°.

In an example embodiment, the tray and the plurality of compartments are formed as one-piece using a thermoplastic material. In an example embodiment, the thermoplastic material is a recyclable polypropylene.

In an example embodiment, the packaging assembly includes a cover covering the opening of the at least one compartment. In an example embodiment, the confer is configured to be removably attached to the base portion. In an example embodiment, the cover hermetically seals the at least one compartment via at least on heat seal.

In an example embodiment, each compartment includes a plurality of volume strips equally distributed on an outer surface of the respective sidewall. In an example embodiment, the volume strips are formed as parallel ridges extending from the first end of the sidewall to the second end of the sidewall and protrude outwardly from an outer surface of the sidewall.

Example embodiments of the present invention relate to a method for transporting and storing ice, the method comprising placing a shaped piece of ice into a compartment of a packaging assembly, the packaging in assembly including a tray having a base portion and a plurality of compartments, each formed on the base portion and configured to receive a respective shaped piece of ice. In an example embodiment, each compartment includes an opening formed on the base portion, a bottom portion substantially parallel to the base portion, at least one sidewall having a first end and a second end, the at least on side wall connecting the base portion to the bottom portion, and at least one volume strip formed in a respective at least one sidewall. In an example embodiment, the method further comprises sealing the at least one shaped piece of ice into the respective compartment of the packaging assembly using at least one cover, the at least one cover configured to be removably attached to the base portion.

In an example embodiment, the plurality of components are formed as at least one of a circular frustum, a square frustum, and a rectangle frustum. In an example embodiment, the at least one sidewall is formed as a circular frustum. In an example embodiment, the second end of the sidewall is connected to the bottom portion at an 94° angle. In an example embodiment, each compartment includes four side walls. In an example embodiment, the second end of each sidewall is connected to the bottom portion at an 93° angle.

In an example embodiment, the at least one shaped piece of ice is hermetically sealed inside the compartment via at least one heat seal. In an example embodiment, the packaging assembly is formed as one-piece using recyclable polypropylene.

Any embodiment of any of the disclosed compositions and/or methods can consist of or consist essentially of—rather than comprise/include/contain/have—any of the described elements and/or features and/or steps. Thus, in any of the claims, the term "consisting of" or "consisting essentially of" can be substituted for any of the open-ended linking verbs recited above, in order to change the scope of a given claim from what it would otherwise be using the open-ended linking verb.

The term "substantially" and its variations are defined as being largely but not necessarily wholly what is specified as understood by one of ordinary skill in the art, and in one non-limiting embodiment substantially refers to ranges within 10%, within 5%, within 1%, or within 0.5%.

The term "about" or "approximately" or "substantially unchanged" are defined as being close to as understood by one of ordinary skill in the art, and in one non-limiting embodiment the terms are defined to be within 10%, preferably within 5%, more preferably within 1%, and most preferably within 0.5%.

The use of the word "a" or "an" when used in conjunction with the term "comprising" in the claims and/or the specification may mean "one," but it is also consistent with the meaning of "one or more," "at least one," and "one or more than one."

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

Other objects, features, and advantages of the present invention will become apparent from the following detailed description. It should be understood, however, that the detailed description and the examples, while indicating specific embodiments of the invention, are given by way of illustration only. Additionally, it is contemplated that changes and modifications within the spirit and scope of the invention will become apparent to those skilled in the art from this detailed description.

The drawings illustrate by way of example and not limitation. For the sake of brevity and clarity, every feature of a given structure is not always labeled in every figure in which that structure appears. Identical reference numbers do not necessarily indicate an identical structure. Rather, the same reference number may be used to indicate a similar feature or a feature with similar functionality, as may non-identical reference numbers. The figures are drawn to scale (unless otherwise noted), meaning the sizes of the depicted elements are accurate relative to each other for at least the embodiment depicted in the figures.

The ice that is placed into the trays of the present invention maybe of any origin, including "handcrafted," artisanal, machine generated or shaped, lake- or spring-harvested, or from any other source, because the trays need not be associated with any particular manufacture or type of ice, and references to any ice source herein are meant to be illustrative and not limiting. Moreover, the composition of the ice is typically water but it need not be chemically pure (such that it could contain for instance minerals, flavorants, herbs, spices, etc.) It also will be understand that materials other than water may be used to make the subject ice (e.g., a solid, semi-solid, crystal, etc.).

In one embodiment of the invention, for instance, ice may be manufactured in large blocks. Those blocks may be slow-formed over a series of days. Once that ice is properly formed to an artisan's specification, the ice can be cut or chiseled or otherwise shaped by hand or by machine cuts along the three-dimensional primary axis directions (often called the x, y and z axis) in such a way as avoids chipping, air pockets, marring, disfiguration, or the like. Such shaping can be done e.g. by utilizing a variety of material handling equipment and platens, maintained to keep the ice in a frozen or near frozen state.

DETAILED DESCRIPTION

Various features and advantageous details are explained more fully with reference to the non-limiting embodiments that are illustrated in the accompanying drawings and detailed in the following description. It should be understood, however, that the detailed description and the specific examples, while indicating embodiments, are given by way of illustration only, and not by way of limitation. Various substitutions, modifications, additions, and/or rearrangements will be apparent to those of ordinary skill in the art from this disclosure.

In the following description, numerous specific details are provided to provide a thorough understanding of the disclosed embodiments. One of ordinary skill in the relevant art will recognize, however, that the invention can be practiced without one or more of the specific details, or with other methods, components, materials, and so forth. In other instances, well-known structures, materials, or operations are not shown or described in detail to avoid obscuring aspects of the invention.

Figure 1E:
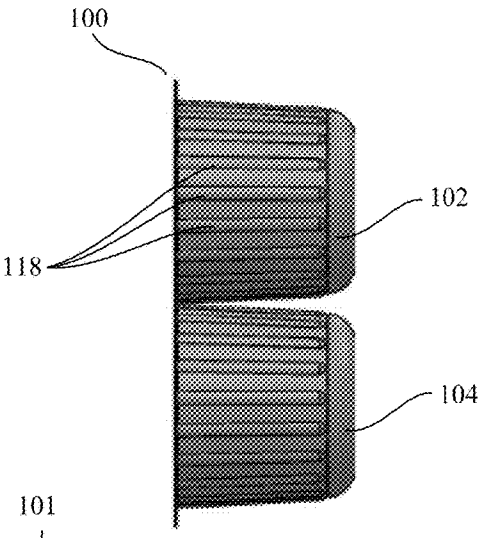
FIG. 1E is a schematic side view of the example packaging according to an example embodiment of the present invention.
Figure 1D:
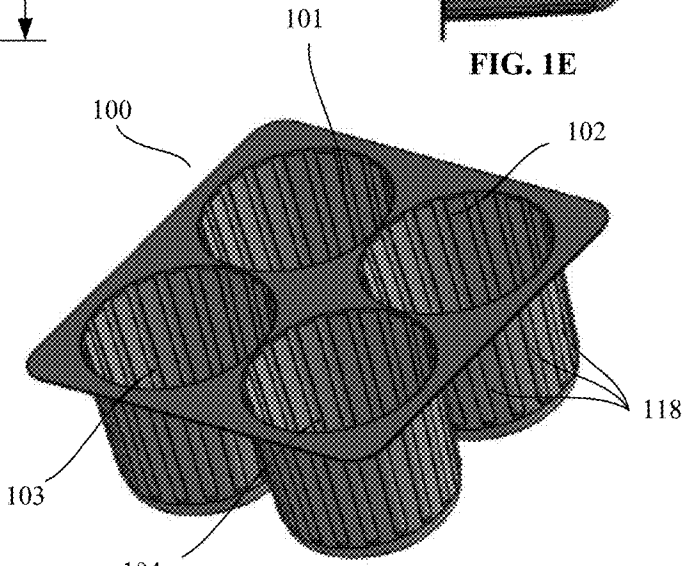
FIG. 1D is a perspective view of the example packaging according to an example embodiment of the present invention.
Figures 2A, 2B, 2C, 2D, 2E:
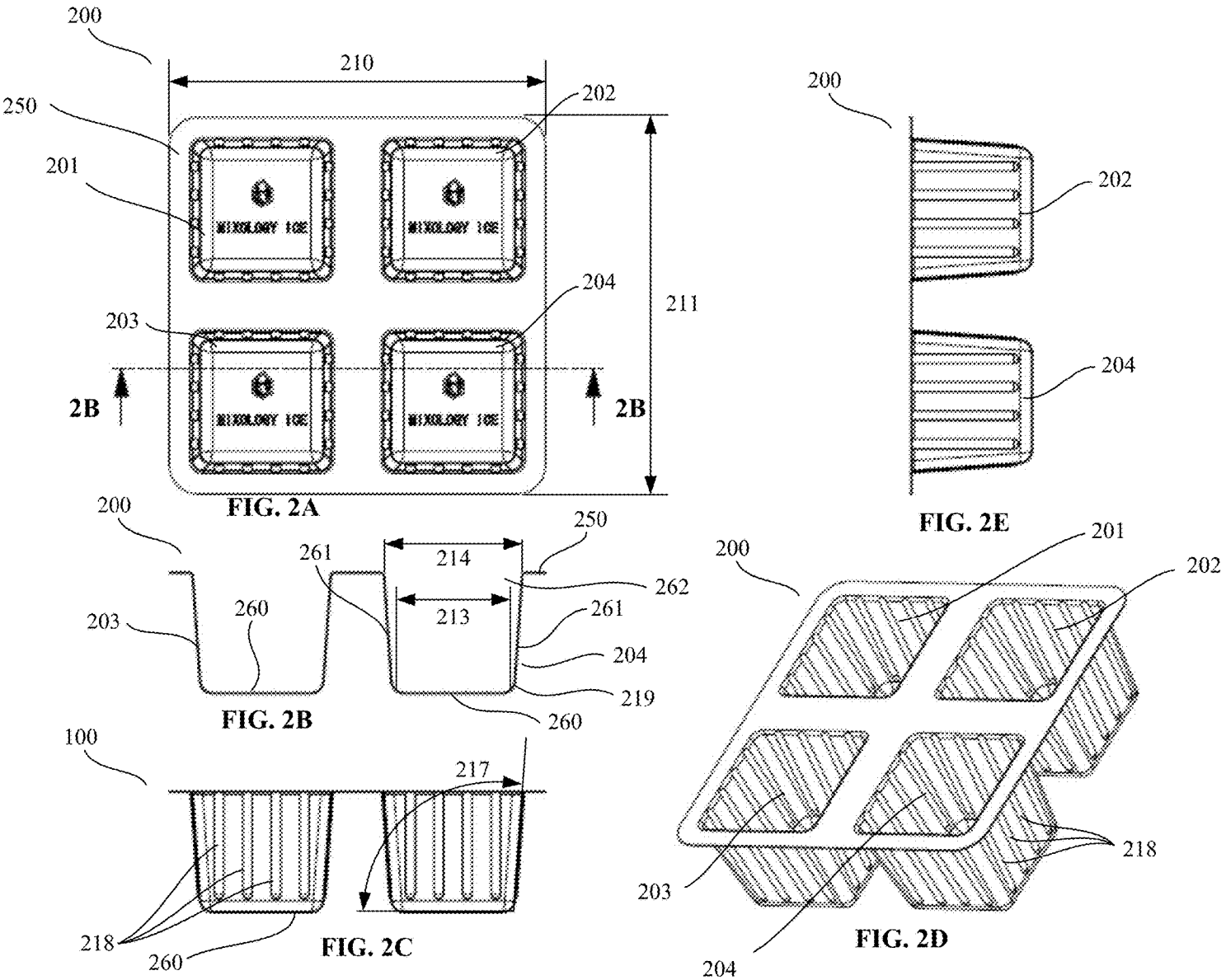
FIG. 2A is a schematic top view of the example packaging according to an example embodiment of the present invention.
FIG. 2B is a schematic section view of the example packaging according to an example embodiment of the present invention.
FIG. 2C is a schematic side view of the example packaging according to an example embodiment of the present invention.
FIG. 2D is a perspective view of the example packaging according to an example embodiment of the present invention.
FIG. 2E is a schematic side view of the example packaging according to an example embodiment of the present invention.
Figure 3E:
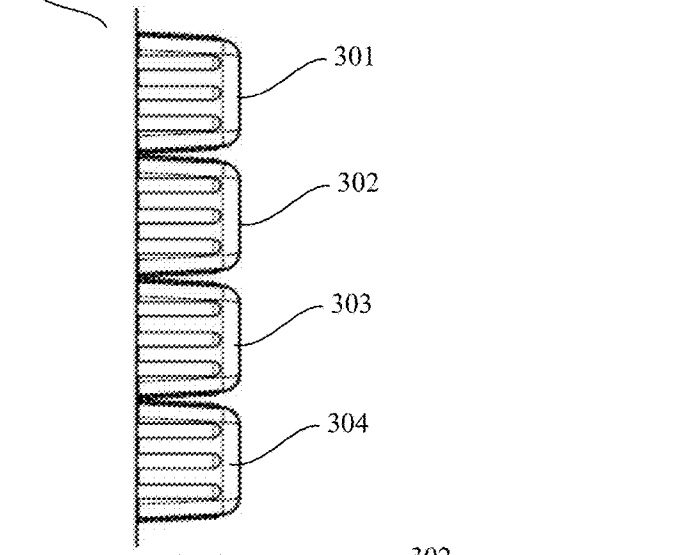
FIG. 3E is a schematic side view of the example packaging according to an example embodiment of the present invention.
Figure 3D:
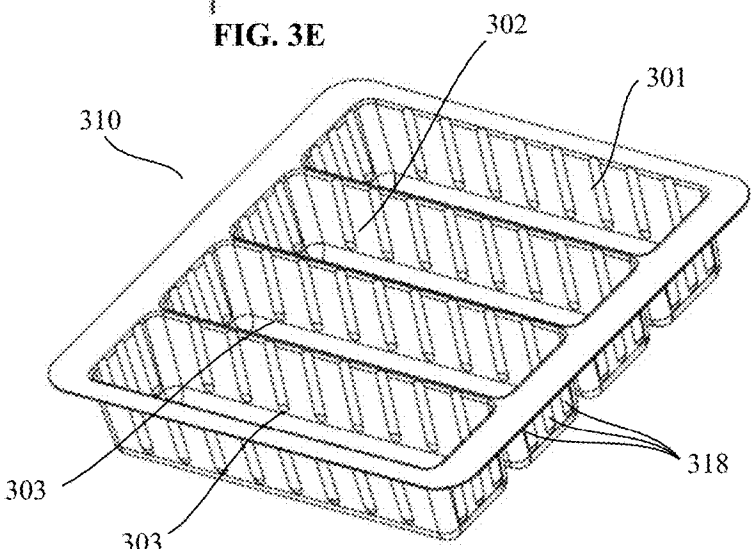
FIG. 3D is a perspective view of the example packaging according to an example embodiment of the present invention.

In an example embodiment, transportation and storage of handcrafted ice may be accomplished using a packaging assembly, as shown in FIGS. 1D, 2D, and 3D. Packaging assemblies include compartments for storing individual pieces of handcrafted ice that may be placed inside a compartment. Once placed inside a compartment, the handcrafted ice may be sealed inside the packaging assembly using a removable cover. For example, the cover may hermetically seal handcrafted ice inside packaging assembly. After transportation of the handcrafted ice is complete, the handcrafted ice may be stored inside packaging assembly until needed. Once needed, a portion of the removable cover covering a particular compartment may be removed so as to expose the handcrafted ice. A force may then be applied to remove the handcrafted ice. For example, a force may be applied to a bottom portion of the compartment which causes the handcrafted ice to dislodge from its compartment. Alternatively, a force may be applied to a bottom portion of the compartment which causes the sidewalls of the compartment to deform which causes the handcrafted ice to dislodge from its component.

For example, the packaging assembly may be designed as a disposable packaging assembly, so that once the handcrafted ice has been removed from the packaging assembly, the packaging assembly may be disposed of and/or recycled.

The rigidity of the packaging assembly and its compartments is selected to ensure that the desirable characteristics of the handcrafted ice, e.g., clarity, shape, absence of cracks, etc., are maintained during transportation, storage, and removal from the packaging assembly. For example, the composition of the packaging assembly is selected to ensure that the humidity, temperature, and transpiration of the handcrafted ice is controlled during transportation, storage, and removal. For example, a suitable plastic material may be used which acts as a barrier to maintain the humidity and temperature inside the compartment.

To facilitate the removal of the handcrafted ice from a compartment, the configuration of a compartment can be selected to ensure that the handcrafted ice is removed without causing damage to the ice. Sidewalls of the compartments may connect to a bottom portion of the compartment at a specific angle. For example, the sidewalls may connect to the bottom portion at an angle greater than 90°. For example, the sidewalls may connect to the bottom portion at an angle in the range of about 91° to about 99°, and preferably in a range of about 93° to about 94°. In this manner, when a force is applied to the bottom portion of the compartment, the handcrafted ice can easily be removed. Furthermore, when a force is applied to the bottom portion of the compartment that causes the sidewalls to deform, the handcrafted ice will not be damaged.

To protect the handcrafted ice during transportation, storage, and removal while still facilitating removal of the handcrafted ice, the bottom portions and corners of the compartments may be thicker than the sidewalls of the compartments. For example, the sidewall may have a thickness in a range of 1.0 mm to 2.0 mm, preferably in a range of 1.25 to 1.75; the portion that connects the sidewall to the bottom may have a thickness in a range of 4 mm to 6 mm, preferably in a range of 4.75 mm to 5.25 mm; and the bottom portion may have a thickness in a range of 4 mm to 6 mm, preferably in a range of 4.75 mm to 5.25 mm. For example, the sidewall may have a thickness of 1.5 mm; the portion that connects the sidewall to the bottom portion may be 5 mm; and the bottom portion may have a thickness of 5 mm.

To protect the handcrafted ice during transportation, storage, and removal and to facilitate the removal of the handcrafted ice, volume strips may be formed in the compartments. These volume strips may be formed in the sidewalls of the compartments and increase the rigidity of the compartment so as to facilitate removal of the handcrafted ice. Additionally, the volume strips enable and promote airflow around the surfaces of the handcrafted ice. Airflow around the handcrafted ice during transportation, storage, and removal is particularly advantageous, as it allows for enhanced humidity and transpiration control and prevents the handcrafted ice from adhering to the compartment, which facilitates removal of the handcrafted ice.

In addition to protecting the handcrafted ice during transportation, storage, and removal, forming equally spaced volume strips on the outer surface of the compartments saves costs associated with shipping the packaging assembly, as the volume strips facilitates and increases the amount of packaging assemblies that can be stacked on top of each other. For example, the volume strips may be formed as ridges formed on the outer surface of a compartment. For example, the volume strips may be equally spaced on the outer surface of the compartment.

Figure 1A:
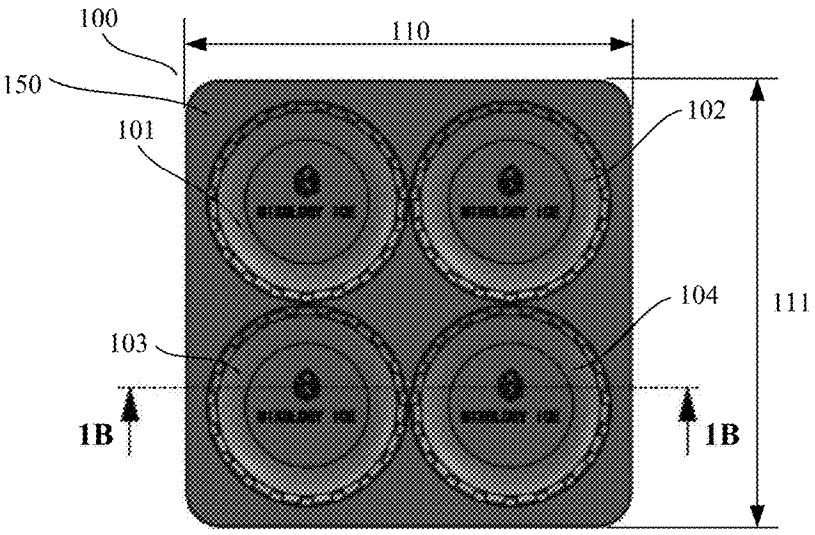
FIG. 1A is a schematic top view of the example packaging according to an example embodiment of the present invention.

FIGS. 1A-1E illustrate an example packaging assembly 100. FIG. 1A is a schematic top view of packaging assembly 100. Packaging assembly may have width 110 and length 111 and include compartments 101-104 formed on base 150 of packaging assembly 100. As shown in FIG. 1A, compartments 101-104 may be arranged on base 150 in a symmetrical pattern, and packaging assembly 100 may be configured to have up to four compartments. For example, compartments 101-104 may be circular and formed to receive spherical shaped handcrafted ice. For example, compartments 101-104 may be configured to receive spherical shaped handcrafted ice having a diameter in the range of 2" to 3", preferably in a range of 2.25" to 2.75." In an example embodiment, the spherical shaped handcrafted ice may have a diameter of 2.5".

Figure 1B:
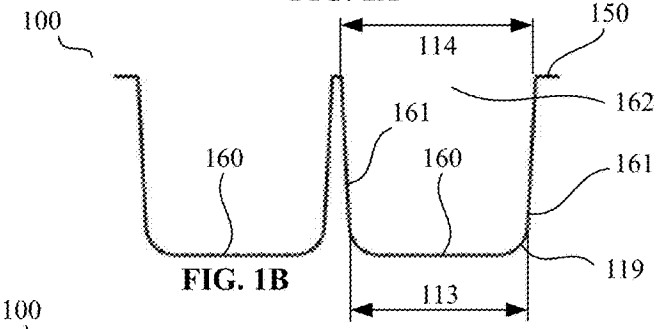
FIG. 1B is a schematic section view of the example packaging according to an example embodiment of the present invention.
Figure 1C:
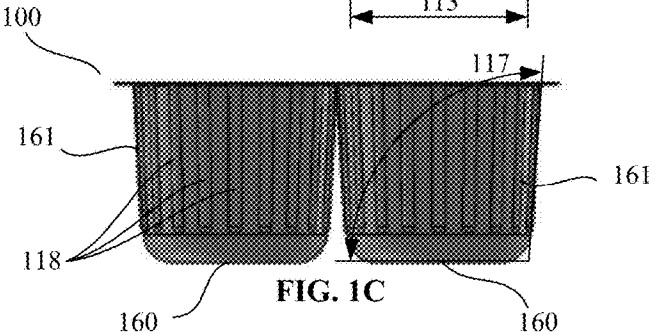
FIG. 1C is a schematic side view of the example packaging according to an example embodiment of the present invention.

FIG. 1B is a schematic section view of line 1B-1B, shown in FIG. 1A. Compartments 103 and 104, as shown in FIG. 1B may include bottom portion 160, sidewalls 161, and opening 162. Sidewalls 161 extend from base portion 150 to bottom portion 160. In an example embodiment, the connection between sidewalls 161 and bottom portion 160 may be formed as fillet 119.

As shown in FIG. 1B, sidewalls 161 of compartments 101-104 may connect to bottom portion 160 at angle 117. For example, angle 117 may be greater than 90°. For example, the angle 117 may be in the range of about 91° to about 99°, preferably in the range of about 92° to about 95°, and more preferably in a range of about 93° to about 94°. In one example, angle 117 is 94°.

As shown in FIG. 1B, opening 162 of compartment 104 may have a dimension of 114, and bottom portion 160 of compartment 104 may have a dimension 113. Compartment 104 may be formed as a circular frustum such that dimension 114 is larger than dimension 113. It has been found that a circular frustum shaped compartment that has an angle of 94° between a sidewall and a bottom portion is particularly advantageous for the transportation, storage, and removal of a handcrafted piece of ice.

As shown in FIGS. 1A, 1C, 1D, and 1E, compartments 101-104 may include volume strips 118 formed on an outer surface of compartments 101-104. For example, volume strips 118 may be formed as ridges outwardly extending from compartments 101-104 outer surface. Volume strips 118 may also be equally spaced on the outer surface of compartments 101-104.

FIGS. 2A-2E illustrate an example packaging assembly 200. FIG. 2A is a schematic top view of packaging assembly 200. Packaging assembly may have width 210 and length 211 and include compartments 201-204 formed on base 250 of packaging assembly 200. As shown in FIG. 2A, compartments 201-204 may be arranged on base 250 in a symmetrical pattern, and packaging assembly 200 may be configured to have up to four compartments. For example, compartments 201-204 may be square shaped and formed to receive cubed shaped handcrafted ice. For example, compartments 201-204 may be configured to receive cubed shaped handcrafted ice having a length in a range of 1" to 3", preferably in a range of 1.5" to 2.5;" a height in a range of 1" to 3", preferably in a range of 1.5" to 2.5;" and a width of in a range of 1" to 3", preferably in a range of 1.5" to 2.5;" In an example embodiment, the cubed shaped handcrafted ice may have a length of 2", height of 2," and a width of 2".

FIG. 2B is a schematic section view of line 2B-2B, shown in FIG. 2A. Compartments 203 and 204, as shown in FIG. 2B may include bottom portion 260, sidewalls 261, and opening 262. Sidewalls 262 extend from base portion 250 to bottom portion 260. In an example embodiment, the connection between sidewalls 261 and bottom portion 260 may be formed as fillet 219

As shown in FIG. 2B, sidewalls 261 of compartments 201-204 may connect to bottom portion 260 at angle 217. For example, angle 217 may be greater than 90°. For example, the angle 217 may be in the range of about 91° to about 99°, preferably in the range of about 92° to about 95°, and more preferably in a range of 93° to 94°. In one example, angle 217 is 93°.

As shown in FIG. 2B, opening 262 of compartment 204 may have a dimension of 214, and bottom portion 260 of compartment 204 may have a dimension 214. Compartment 204 may be formed as a square frustum such that dimension 214 is larger than dimension 213. It has been found that a square frustum shaped compartment that has an angle of 93° between a sidewall and a bottom portion is particularly advantageous for the transportation, storage, and removal of a handcrafted piece of ice.

As shown in FIGS. 2A, 2C, 2D, and 2E, compartments 201-204 may include volume strips 218 formed on an outer surface of compartments 201-204. For example, volume strips 218 may be formed as ridges outwardly extending from compartments 201-204 outer surface. Volume strips 218 may also be equally spaced on the outer surface of compartments 201-204.

Figure 3A:
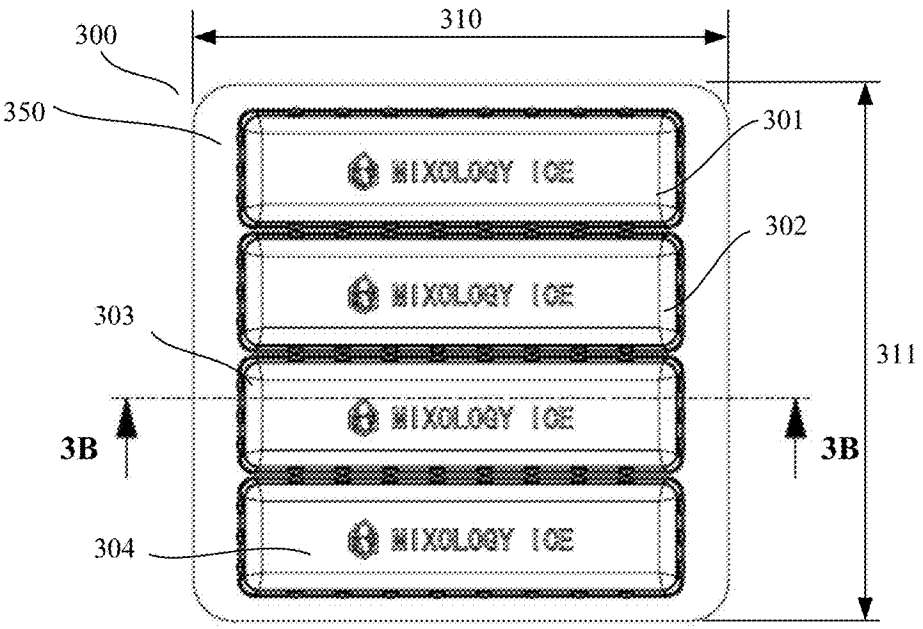
FIG. 3A is a schematic top view of the example packaging according to an example embodiment of the present invention.

FIGS. 3A-3E illustrate an example packaging assembly 300. FIG. 3A is a schematic top view of packaging assembly 300. Packaging assembly may have width 310 and length 311 and include compartments 301-304 formed on base 350 of packaging assembly 300. As shown in FIG. 3A, compartments 301-304 may be arranged on base 350 in a symmetrical pattern, and packaging assembly 300 may be configured to have up to four compartments. For example, compartments 301-304 may be rectangular shaped and formed to receive rectangular shaped handcrafted ice. For example, compartments 301-304 may be configured to receive rectangular shaped handcrafted ice having a length in a range of 4" to 6", preferably in a range of 4.5" to 5.5;" a height in a range of 0.75" to 1.75", preferably in a range of 1.0" to 1.5;" and a width of in a range of 0.75" to 1.75", preferably in a range of 1.0" to 1.5;" In an example embodiment, the cubed shaped handcrafted ice may have a length of 5", height of 1.25," and a width of 1.25".

Figure 3B:
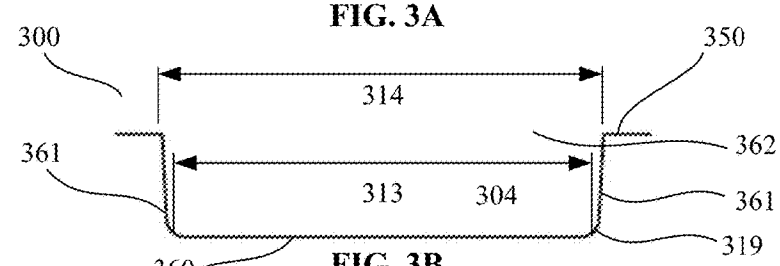
FIG. 3B is a schematic section view of the example packaging according to an example embodiment of the present invention.
Figure 3C:
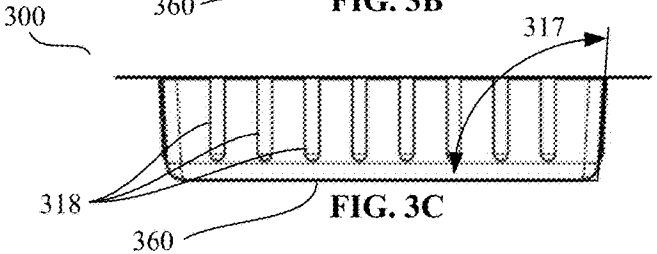
FIG. 3C is a schematic side view of the example packaging according to an example embodiment of the present invention.

FIG. 3B is a schematic section view of line 3B-3B, shown in FIG. 3A. Compartment 304, as shown in FIG. 3B may include bottom portion 360, sidewalls 361, and opening 362. Sidewalls 362 extend from base portion 350 to bottom portion 360. In an example embodiment, the connection between sidewalls 361 and bottom portion 360 may be formed as fillet 319

As shown in FIG. 3B, sidewalls 361 of compartments 301-304 may connect to bottom portion 360 at angle 317. For example, angle 317 may be greater than 90°. For example, the angle 317 may be in the range of about 91° to about 99°, preferably in the range of about 92° to about 95°, and more preferably in a range of 93° to 94°. In one example, angle 317 is 93°.

As shown in FIG. 3B, opening 362 of compartment 304 may have a dimension of 314, and bottom portion 360 of compartment 304 may have a dimension 314. Compartment 304 may be formed as a rectangle frustum such that dimension 314 is larger than dimension 313. It has been found that a rectangle frustum shaped compartment that has an angle of 93° between a sidewall and a bottom portion is particularly advantageous for the transportation, storage, and removal of a handcrafted piece of ice.

As shown in FIGS. 3A, 3C, 3D, and 3E, compartments 301-304 may include volume strips 318 formed on an outer surface of compartments 301-304. For example, volume strips 318 may be formed as ridges outwardly extending from compartments 301-304 outer surface. Volume strips 318 may also be equally spaced on the outer surface of compartments 301-304.

Figure 4A:
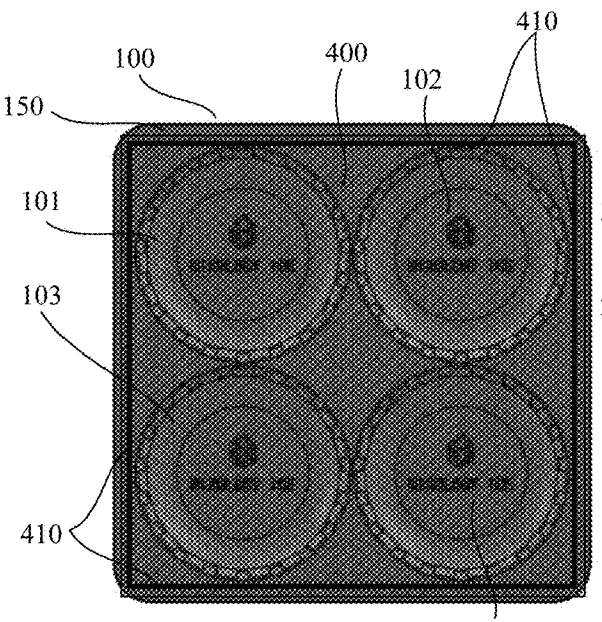
FIG. 4A is a schematic top view of the example packaging according to an example embodiment of the present invention.
Figure 4B:
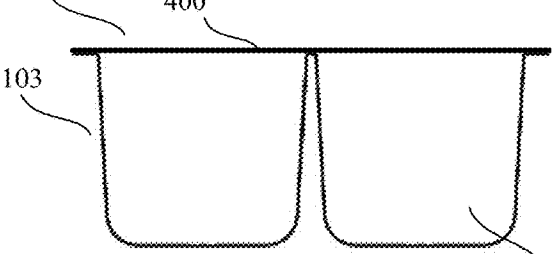
FIG. 4B is a schematic section view of the example packaging according to an example embodiment of the present invention.

FIG. 4A illustrate packaging assembly 100 with cover 400 applied to base 150, and FIG. 4B is a schematic section view of FIG. 4A. Cover 400 may be for example, a thermoplastic material. Cover 400 may be used to hermetically seal compartments 101-104. For example, cover 400 may be sealed via heat seals 410.

Figure 5A:
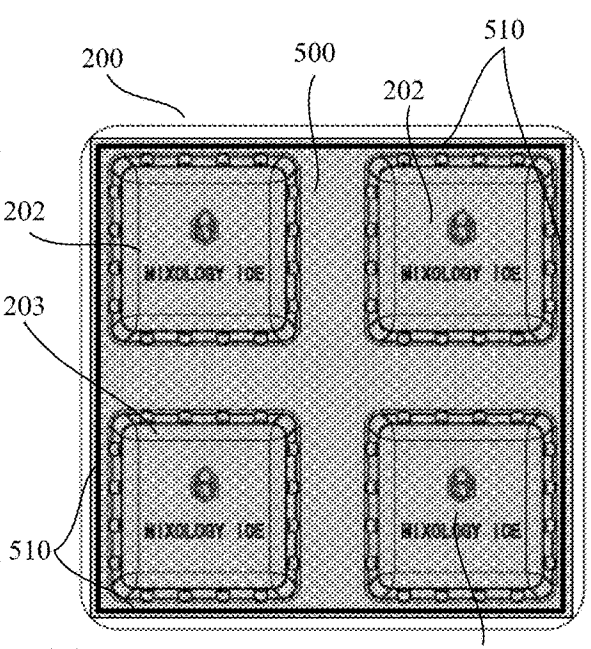
FIG. 5A is a schematic top view of the example packaging according to an example embodiment of the present invention.
Figure 5B:
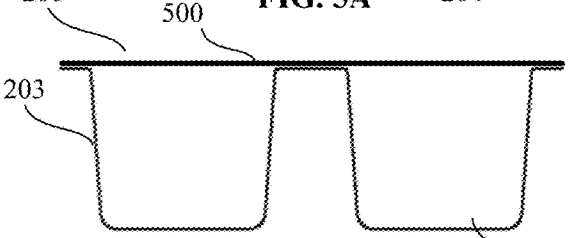
FIG. 5B is a schematic section view of the example packaging according to an example embodiment of the present invention.

FIG. 5A illustrate packaging assembly 200 with cover 500 applied to base 250, and FIG. 5B is a schematic section view of FIG. 5A. Cover 500 may be used to hermetically seal compartments 201-204. For example, cover 500 may be sealed via heat seals 510.

Figure 6A:
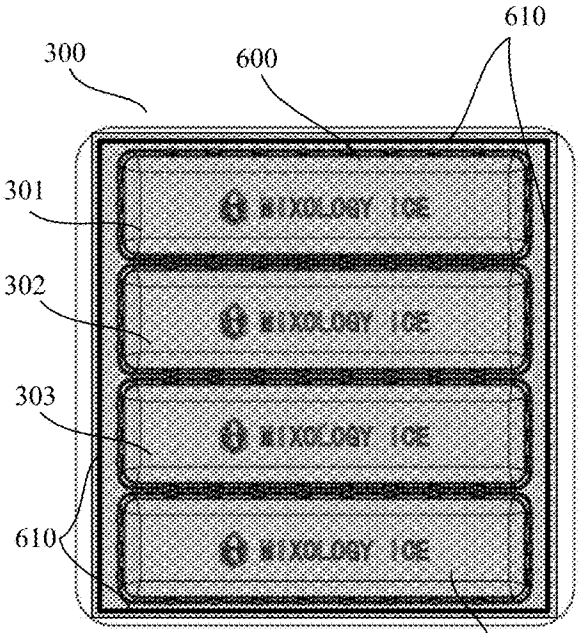
FIG. 6A is a schematic top view of the example packaging according to an example embodiment of the present invention.
Figure 6B:
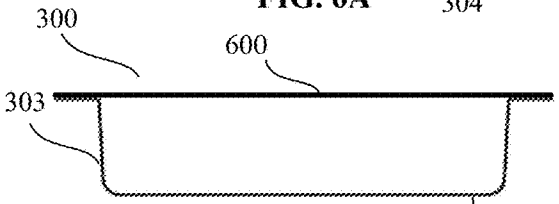
FIG. 6B is a schematic section view of the example packaging according to an example embodiment of the present invention.

FIG. 6A illustrate packaging assembly 300 with cover 600 applied to base 350, and FIG. 6B is a schematic section view of FIG. 6A. Cover 600 may be used to hermetically seal compartments 301-304. For example, cover 600 may be sealed via heat seals 610.

The described example embodiments are understood to be embodiments of the invention that are applicable to all aspects of the invention, including compositions and methods.

While this specification contains many specific implementation details, these should not be construed as limitations on the scope of any inventions or of what may be claimed, but rather as descriptions of features specific to particular embodiments of particular inventions. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can in some cases be excised from the combination, and the claimed combination may be directed to a subcombination or variation of a subcombination.

Similarly, while operations are depicted in the drawings in a particular order, this should not be understood as requiring that such operations be performed in the particular order shown or in sequential order, or that all illustrated operations be performed, to achieve desirable results. In certain circumstances, multitasking and parallel processing may be advantageous. Moreover, the separation of various system components in the embodiments described above should not be understood as requiring such separation in all embodiments, and it should be understood that the described components and systems can generally be integrated together in a single product or packaged into multiple products.

Thus, particular embodiments of the subject matter have been described. Other embodiments are within the scope of the following claims.

The claims are not to be interpreted as including means-plus- or step-plus-function limitations, unless such a limitation is explicitly recited in a given claim using the phrase(s) "means for" or "step for," respectively.

What is claimed is:

1. A packaging assembly for transporting and storing ice, the packaging assembly comprising:

a tray having a substantially planar base portion;

a plurality of compartments each formed on the base portion and configured to receive at least one piece of ice, wherein each compartment includes:

an opening formed on and substantially planar with the base portion;

a bottom portion substantially parallel to the base portion;

at least one sidewall having a first end and a second end, the at least one sidewall connecting the base portion at the first end to the bottom portion at the second end via a curved portion, wherein an entire perimeter of the first end of the at least one sidewall is substantially flush with the base portion, wherein each of the at least one sidewall is angled such that each compartment of the plurality of compartments has a first dimension at the first end that is larger than a second dimension at the second end; and a plurality of volume strips formed in an outer surface of the at least one sidewall, wherein each of the plurality of volume strips extending linearly from the base portion to the curved portion and not extending into the curved portion, wherein the plurality of volume strips are evenly distributed around the entirety of the at least one sidewall, wherein the plurality of volume strips are uniform with one another; and a substantially planar cover in contact with the base portion, wherein the cover is configured to be removably attached to the base portion and seal the opening of each of the plurality of compartments.

2. The packaging assembly of claim 1, wherein the at least one sidewall is formed as a circular frustum so that the first end has a diameter larger than a diameter of the second end.

3. The packaging assembly of claim 2, wherein the second end of the sidewall is connected to the bottom portion at an angle that is greater than 90°.

4. The packaging assembly of claim 3, wherein the second end of the sidewall is connected to the bottom portion at an angle that is between about 91° and about 99°.

5. The packaging assembly of claim 4, wherein the angle is about 94°.

6. The packaging assembly of claim 1, wherein each compartment includes four sidewalls so that each compartment is formed as at least one of a square frustum and a rectangle frustum.

7. The packaging assembly of claim 6, wherein the second end of each sidewall is connected to the bottom portion at an angle that is greater than 90°.

8. The packaging assembly of claim 7, wherein the second end of the sidewall is connected to the bottom portion at an angle that is between about 91° and about 99°.

9. The packaging assembly of claim 8, wherein the angle is about 93°.

10. The packaging assembly of claim 1, wherein the tray and the plurality of compartments are formed as one-piece using a recyclable polypropylene.

11. The packaging assembly of claim 1, wherein the packaging assembly includes four compartments.

12. The packaging assembly of claim 1, wherein the cover is hermetically sealed against the at least one compartment via at least one heat seal.

13. The packaging assembly of claim 1, wherein the volume strips are formed as parallel ridges extending from the first end of the sidewall to the second end of the sidewall and protrude outwardly from an outer surface of the sidewall.

* * * * *